US010674787B2

(12) United States Patent
Amis et al.

(10) Patent No.: US 10,674,787 B2
(45) Date of Patent: Jun. 9, 2020

(54) FOOTBED FOR ARTICLE OF FOOTWEAR

(71) Applicant: NIKE, Inc., Beaverton, OR (US)

(72) Inventors: Sam Amis, Portland, OR (US); Thomas J. Rushbrook, Portland, OR (US); Alison Sheets-Singer, Portland, OR (US); Timothy J. Smith, Portland, OR (US); Scott R. Berggren, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 367 days.

(21) Appl. No.: 15/087,644

(22) Filed: Mar. 31, 2016

(65) Prior Publication Data

US 2016/0302518 A1 Oct. 20, 2016

Related U.S. Application Data

(60) Provisional application No. 62/148,011, filed on Apr. 15, 2015.

(51) Int. Cl.

| | |
|---|---|
| ***A43B 13/12*** | (2006.01) |
| ***A43B 13/32*** | (2006.01) |
| ***A43B 17/00*** | (2006.01) |
| ***A43B 17/18*** | (2006.01) |

(52) U.S. Cl.
CPC ..... *A43B 13/12* (2013.01); *A43B 13/32* (2013.01); *A43B 17/006* (2013.01); *A43B 17/18* (2013.01)

(58) Field of Classification Search
CPC ..... A43B 17/14; A43B 17/00; A43B 17/18; A43B 17/006; A43B 13/12; A43B 13/32
See application file for complete search history.

(56) References Cited

U.S. PATENT DOCUMENTS

| | | | | |
|---|---|---|---|---|
| 2,586,045 A * | 2/1952 | Hoza | A43B 1/04 36/14 |
| 3,071,877 A * | 1/1963 | Stickles | A43B 17/00 36/140 |
| 4,194,249 A * | 3/1980 | Thorneburg | A41B 11/003 2/239 |
| 4,261,061 A * | 4/1981 | McAlvage | A41B 11/00 2/239 |
| 5,154,682 A * | 10/1992 | Kellerman | A43B 1/0072 36/178 |

(Continued)

FOREIGN PATENT DOCUMENTS

| | | |
|---|---|---|
| DE | 2805649 A1 | 8/1979 |
| WO | 9519717 A1 | 7/1995 |
| WO | 2006019042 A1 | 2/2006 |

OTHER PUBLICATIONS

International Search Report and Written Opinion dated Jun. 24, 2016 for International Patent Application No. PCT/US2016/027884, 7 pages.

(Continued)

*Primary Examiner* — Jila M Mohandesi
(74) *Attorney, Agent, or Firm* — Shook, Hardy & Bacon L.L.P.

(57) ABSTRACT

A footbed having the ability to fixedly secure the forefoot portion of the foot while allowing the heel portion to laterally move during activity is provided. The footbed can include a sock liner positioned thereon wherein the sock liner is more firmly secured to the footbed in the forefront region than in the heel region to allow lateral movement.

20 Claims, 7 Drawing Sheets

(56) References Cited

U.S. PATENT DOCUMENTS

| | | | | |
|---|---|---|---|---|
| 5,586,398 | A * | 12/1996 | Carlson | A43B 5/06 36/114 |
| 5,933,984 | A * | 8/1999 | Carlson | A43B 17/14 36/127 |
| 7,082,704 | B2 * | 8/2006 | Throneburg | A43B 7/16 36/25 R |
| 7,908,772 | B2 * | 3/2011 | Celia | A43B 1/0045 36/100 |
| 8,413,818 | B1 * | 4/2013 | Kruckenberg | B01D 35/30 210/235 |
| 2003/0061739 | A1 | 4/2003 | Polifroni | |
| 2006/0021252 | A1 | 2/2006 | Throneburg et al. | |
| 2006/0026866 | A1 | 2/2006 | Avent et al. | |
| 2008/0040952 | A1 | 2/2008 | Celia | |
| 2013/0247415 | A1 * | 9/2013 | Kohatsu | A43B 3/0031 36/88 |
| 2014/0173945 | A1 | 6/2014 | Lin | |
| 2014/0366399 | A1 | 12/2014 | Wakeland et al. | |

OTHER PUBLICATIONS

International Preliminary Report on Patentability dated Oct. 26, 2017 in International Patent Application No. PCT/US2016/027884, 9 pages.

* cited by examiner

FOOTBED FOR ARTICLE OF FOOTWEAR

CROSS-REFERENCE TO RELATED APPLICATIONS

This application claims the benefit of U.S. Provisional Application 62/148,011, entitled Footbed for Article of Footwear, filed on Apr. 15, 2015. The entireties of the aforementioned application are incorporated by reference herein.

BACKGROUND

An article of footwear is oftentimes designed to securely position the wearer's foot within the footwear. More specifically, the footwear is designed to ensure that the wearer's foot does not move or slide longitudinally or laterally within the shoe. The conventional wisdom is that motion can possibly inhibit stability and create foot irritation. However, it may be desirable (due to the natural motion of the foot) to have at least a portion of the foot firmly secured to the footwear and another portion of the foot able to move relative to the footwear.

BRIEF DESCRIPTION OF THE DRAWINGS

The present invention is described in detail herein with reference to the attached drawing figures, like reference numerals are used to indicate like structures, wherein.

DETAILED DESCRIPTION

In general, aspects herein are directed to providing an article of footwear wherein the heel/rear foot area of a wearer's foot can be laterally articulated or moved slightly within the footwear while the wearer's forefoot remains relatively fixed. This aspect can be accomplished by providing a sock liner which is relatively affixed to an insole (and thus the footbed) via friction in the forefoot region of the article of footwear, but is allowed to slide both medially and laterally with respect to the insole (and thus the footbed) in the heel/rear foot area.

At a high level, aspects herein relate to a footbed having the ability to fixedly secure the forefoot portion of the foot while allowing the heel portion to laterally move during activity. This aspect includes a footbed with a sock liner positioned thereon wherein the sock liner is more firmly secured to the footbed in the forefoot region than in the heel region. Further aspects contemplate another portion between a user's foot and the ground where the interaction between two or more layers allows for greater movement in the heel region than in the forefoot region. The two-layer interaction may be between a midsole/outsole, an insole/midsole, a sock liner/insole, an insole/outsole, a sock/sock liner, a sock/foot, and the like layer combinations to allow for the greater degree of medial and/or lateral movement in the heel region than in the forefoot region.

Figure 1:
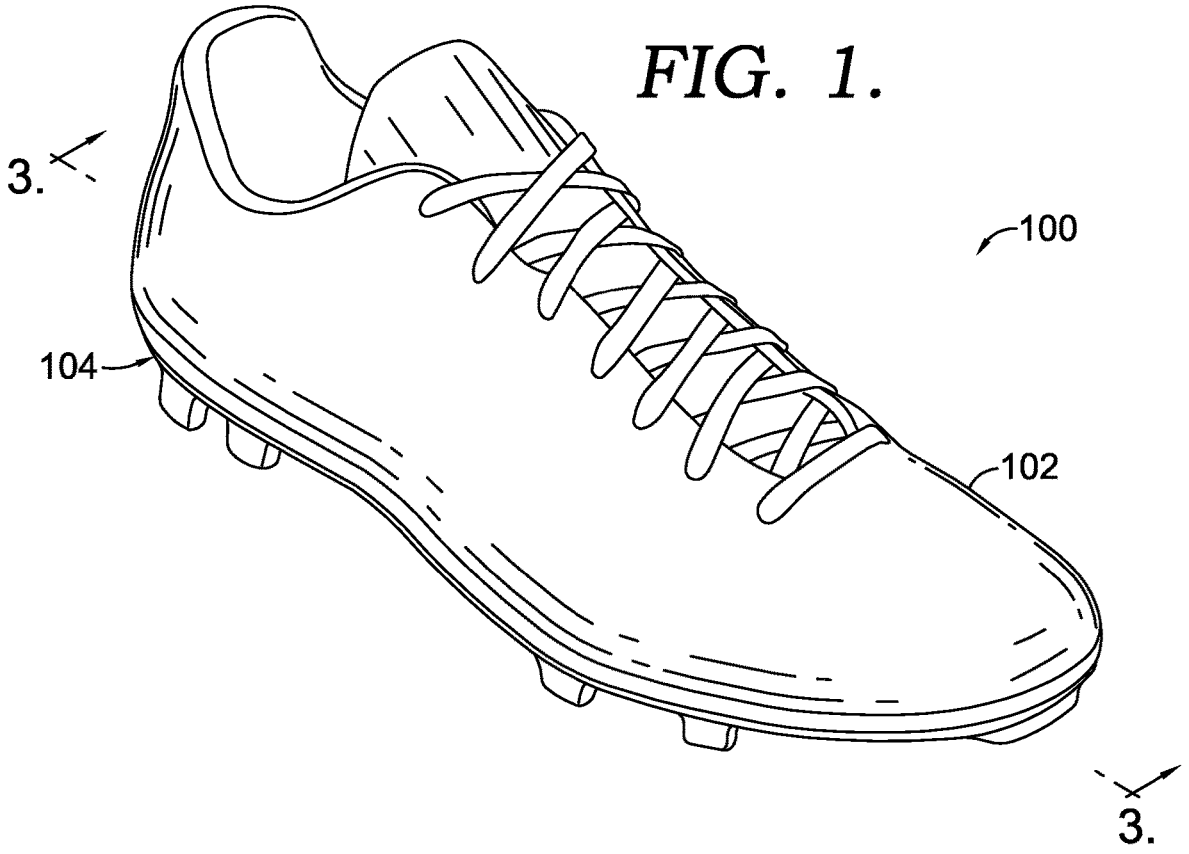
FIG. 1 depicts a perspective view of an article of footwear having an upper and an outsole, in accordance with an aspect hereof.
Figure 2:
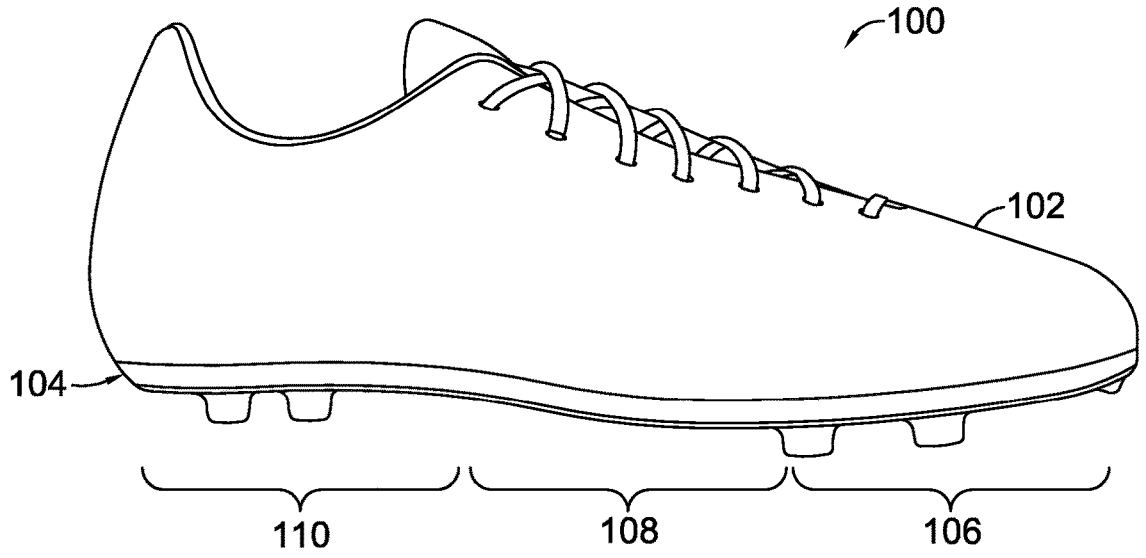
FIG. 2 depicts a side elevational view of the footwear of FIG. 1, in accordance with an aspect hereof.

Referring now to FIGS. 1 and 2, an exemplary article of footwear 100 in accordance with aspects herein is shown. Footwear 100 includes an upper 102 and a sole structure or footbed 104. For reference purposes, footwear 100 may have a forefoot area 106, a midfoot area 108, and a heel/rear foot area 110. Forefoot area 106 is proximate to portions of footwear 100 that correspond with the toes. Midfoot area 108 includes portions of footwear 100 corresponding with middle portions of the foot. Heel/rear foot area 110 is opposite forefoot area 106 and is proximate to portions of footwear 100 that correspond with the heel of the foot. Areas 106, 108, 110 are intended to represent general areas of footwear 100 to aid in the following discussion.

Figure 4:
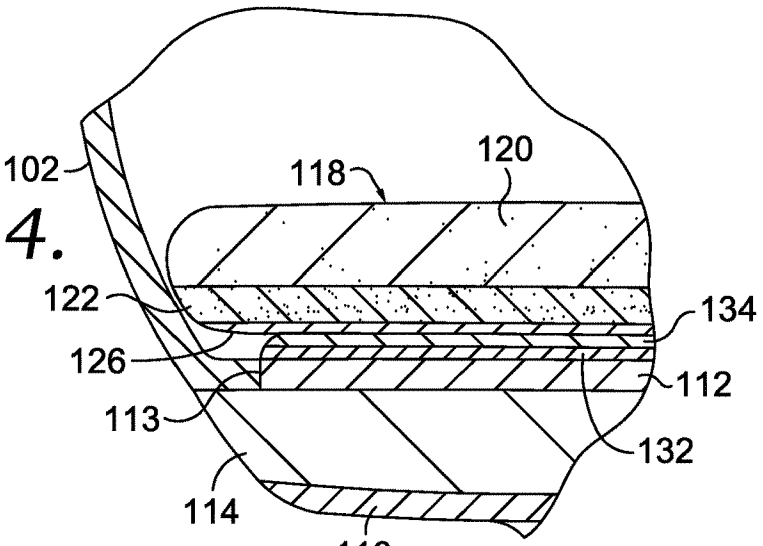
FIG. 4 depicts an enlargement of region 4 in FIG. 3, in accordance with an aspect hereof.
Figure 3:
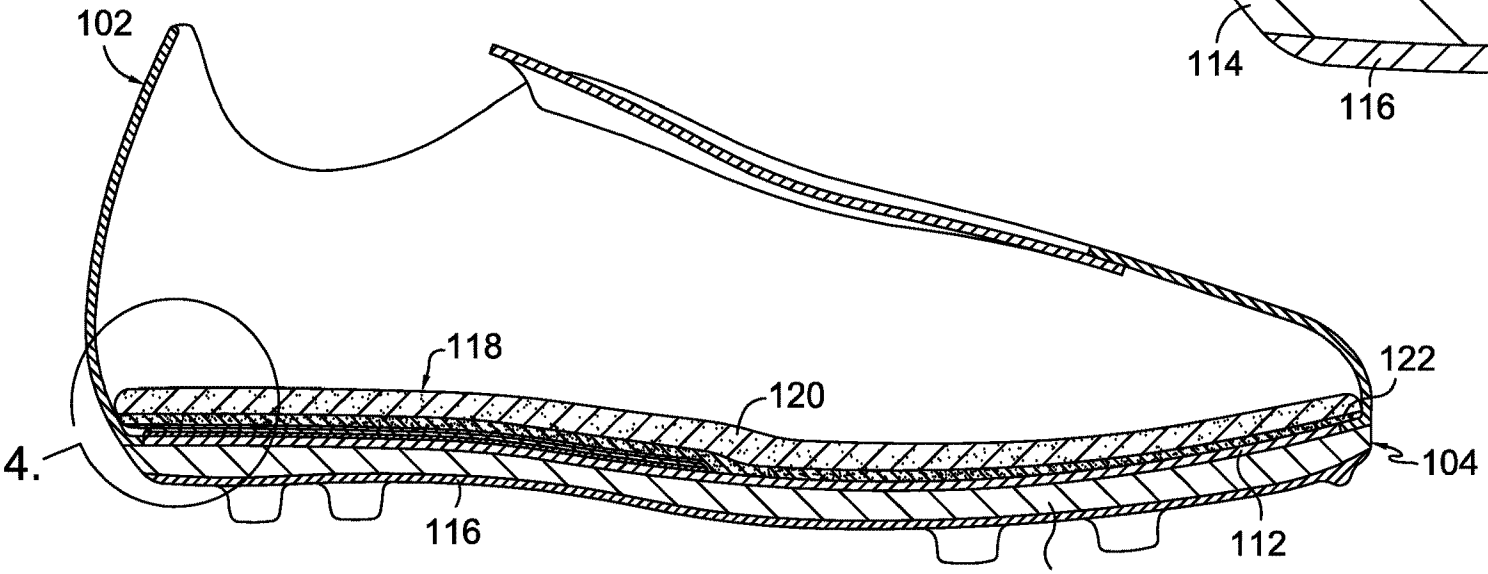
FIG. 3 depicts a sectional view along lines 3-3 of FIG. 1, in accordance with an aspect hereof, wherein the insole of the footwear is stitched as part of the upper.
Figure 5:
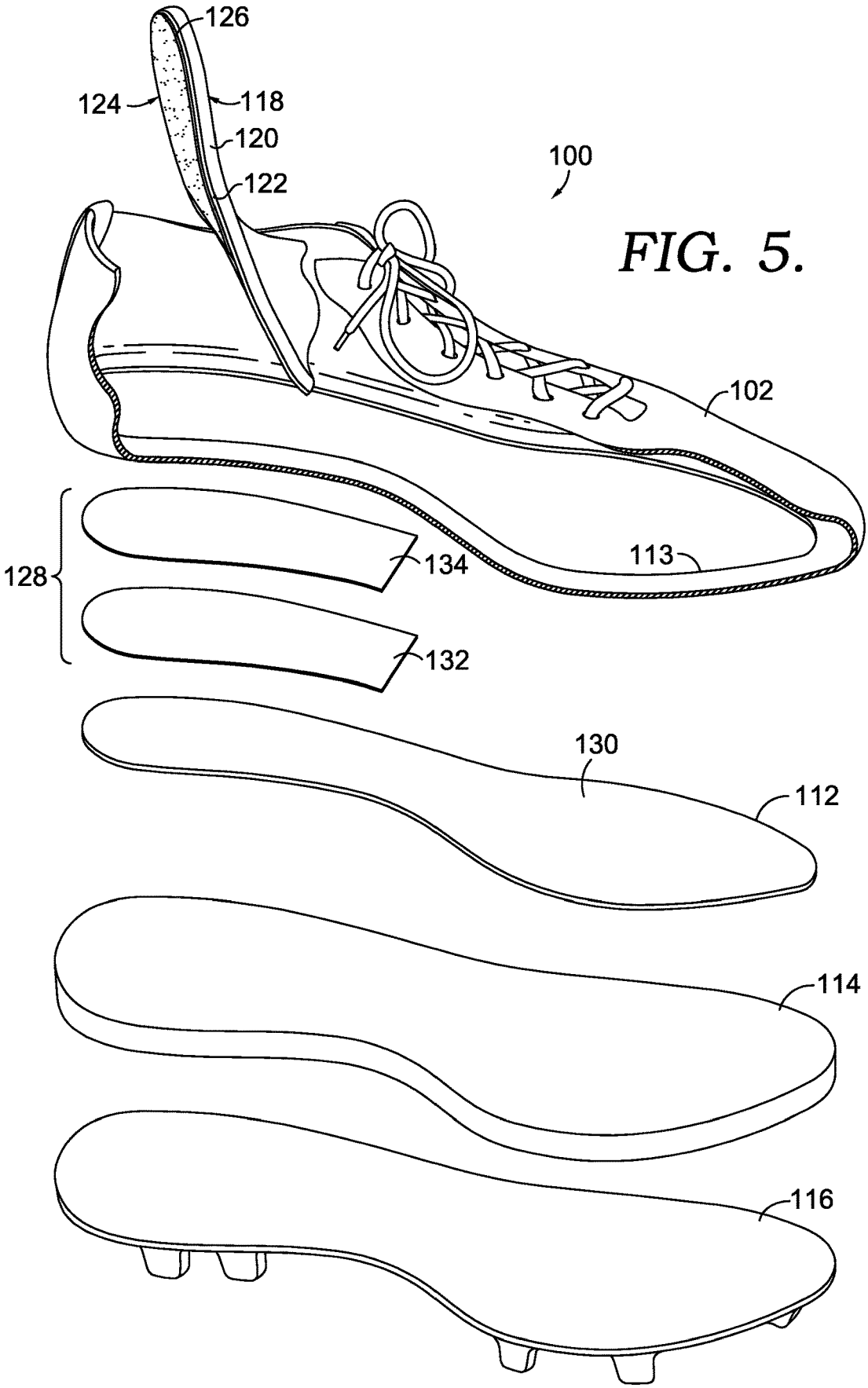
FIG. 5 depicts an exploded perspective view of the footwear of FIG. 1, in accordance with an aspect hereof.

With reference to FIGS. 3-5, sole 104 may include multiple components, such as one or more of an insole 112, a midsole 114, and an outsole 116. As shown in FIGS. 3 and 5, insole 112 may be formed as part of upper 102 via stitching the insole to upper 102 along an edge or stitch line 113. More specifically, when upper 102 is lasted, insole 112 is stitched to upper 102 along line 113 to form the bottom portion of upper 102 that corresponds generally to the bottom of the wearer's foot. In this aspect, insole 112 and the edge portions of upper 102 that are attached thereto form the bottom portion of the upper that is secured to midsole 114 via adhesive, stitching, welding or other suitable connection aspects. In this construction aspect of footwear 100, insole 112 is often referred to as a "strobel." Insole 112 can be made from cellulosic paperboard, synthetic nonwoven insole board, polymer-based materials, composite materials and/or injected molded materials. Insole 112 can typically be 1.0 mm to 1.2 mm thick, but other thicknesses can be used depending upon the desired function and construction characteristics.

Midsole 114 may be made or formed from foam cushioning sheets, latex, ethylene vinyl acetate ("EVA"), polyurethane, plastic, thermoplastic, or blends thereof. Outsole 116 can be connected to the bottom of midsole 114. Outsole 116 is made for directly contacting the ground. Casual or athletic footwear usually have outsoles made from natural rubber, plastic, or a synthetic material like polyurethane. Outsole 116 may comprise a single piece of material or may be an assembly of separate pieces of different materials. Outsole 116 may also include traction elements such as cleats or spikes.

With reference to FIGS. 3-6, footwear 100 includes a rear foot articulating sock liner 118. Sock liner 118 can be made of a polyethylene foam or any other suitable material, and can be molded or die cut. Additionally, sock liner 118 can be made of two or more layers, including a top foot-engaging layer 120 and a bottom insole-engaging layer 122. These layers can be connected in any suitable manner or may be formed together in a molding process. Top layer 120 is made of a thicker, softer foam to allow top layer 120 to conform to the bottom of the wearer's foot, and to provide substantial friction between the foot of the wearer and the top layer 120 of sock liner 118. The friction of between the user's foot and the top layer 120 is greater than the friction experienced between the insole-engaging layer 122 and the insole 112.

Figure 6:
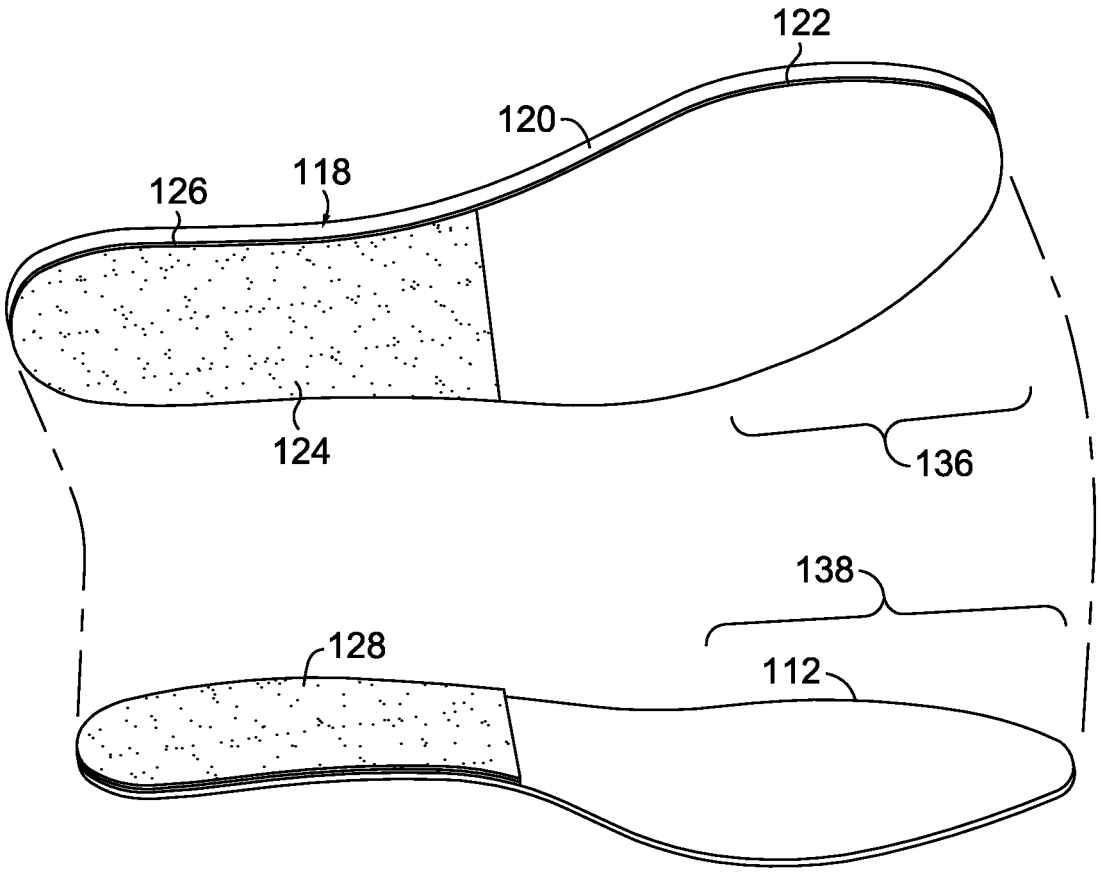
FIG. 6 depicts an exploded perspective view of an insole and a foot liner showing the relative engagement between the two structures, in accordance with an aspect hereof.

FIGS. 5 and 6 show bottom layer 122 of sock liner 118. Bottom layer 122 includes a rear foot/heel low friction area 124. As will be more fully explained below, low friction area 124 is positioned generally in heel area 110 and allows sock liner 118 to move medially and laterally with respect to insole 112. As shown in FIGS. 4 and 5, low friction area 124 can be constructed by adding or applying an additional layer 126 to lower layer 122. Layer 126 can be a slippery textile, mesh, synthetic suede-like "Tirrenina" material, or synthetic leather material, which is applied directly to the bottom surface of the heel region of sock liner 118 so that it interfaces directly with insole 112. These materials are exemplary only, and any other sort of material or lubricant (wet or dry) which decreases friction between sock liner 118 and insole 112 can be used.

As used herein, a low friction area is a region that has a lower coefficient of friction than another region. Generally, traditional forces experience by a first material in contact with a second material will cause the first and second materials to move relative to one another in a low friction area, and they will move to a lesser degree (or not at all) in a high friction area. As applied to an article of footwear, a low friction area would provide for a first material to move relative to a second material. Similarly, as applied to an article of footwear, a high friction area would provide for a first material to remain static, or move less than an amount experienced in a low friction area, relative to a second material when a similar amount of force is experienced for those materials in the article of footwear.

With further reference to FIGS. 4 and 5, insole 112 is also provided with a low friction area 128 in heel area 110 of footwear 100. With specific reference to FIG. 5, an insole top surface 130 is shown including a rear foot low friction area 128 that corresponds to sock liner low friction area 124. More specifically, sock liner low friction area 124 and insole low friction area 128 engage one another to ensure medial and lateral movement of the rear portion of sock liner 118 in relation to insole 112 (and thus sole structure 104). Insole low friction area 128 may be made by providing a first layer 132 of a polypropylene or plastic type material positioned on upper surface 130 of insole 112 in heel area 110. Still further, positioned on top of layer 132 can be a very low friction material layer 134. Layer 134 can be made of any suitable low friction material, for instance a lubricious fluoropolymer material (e.g., polytetrafluoroethylene (PTFE), perfluoroalkoxy alkanes (PFA), etc.) or tape. As is apparent, any suitable layer or layers of low friction materials can be utilized to create insole low friction area 128. Low friction area 128 can also be formed of just layers 132 and 134 without additionally including material of insole 112 at the low friction area.

Figure 7:
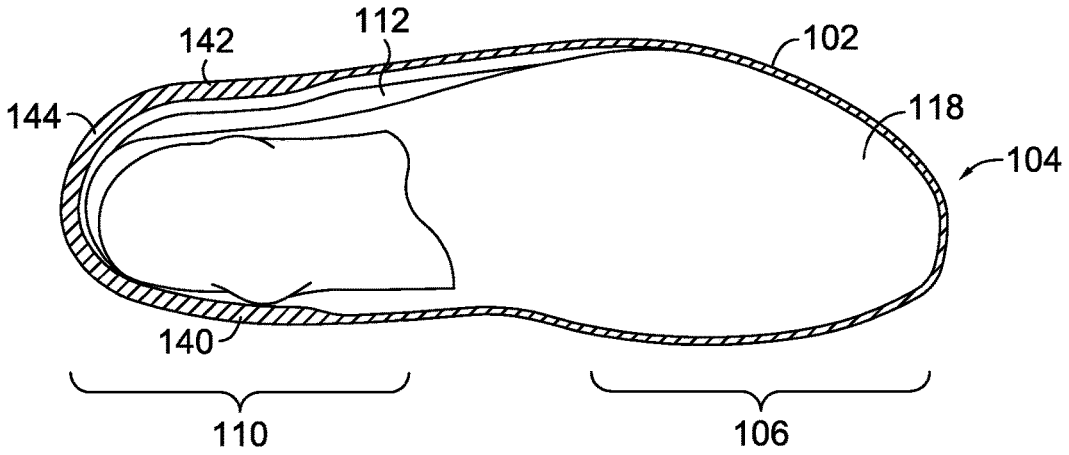
FIG. 7 depicts a diagrammatic top plan view showing the medial articulation of the rear portion of the sock liner in relation to the insole, in accordance with an aspect hereof.
Figure 8:
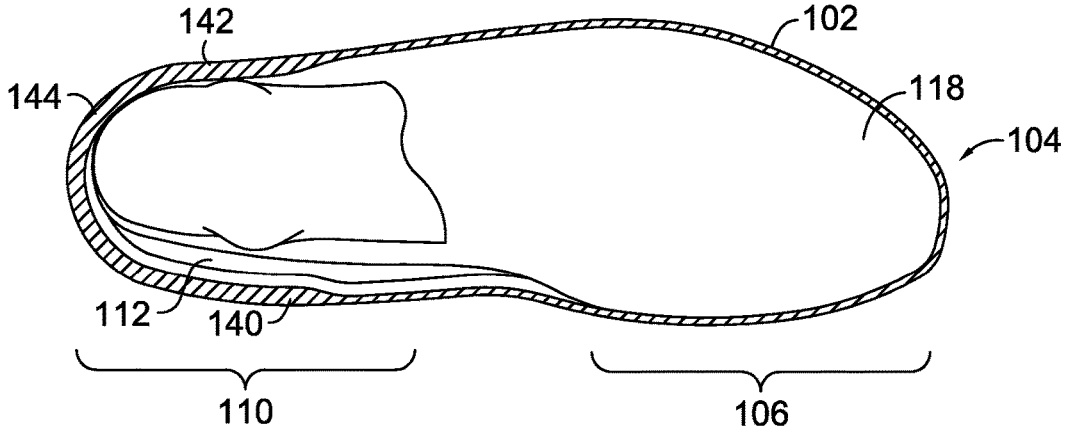
FIG. 8 depicts a diagrammatic top plan view showing the lateral articulation of the rear portion of the sock liner in relation to the insole, in accordance with an aspect hereof.

With reference to FIGS. 6-8, the articulation or pivoting of the rear foot area of sock liner 118 with respect to the rear foot area of insole 112 will be described. More specifically, FIGS. 6-8 depict a diagrammatic view of a footbed of footwear 100 wherein forefoot area 136 of sock liner 118 is fixed relative to forefoot area 138 of insole 112. Sock liner forefoot area 136 can be secured to insole forefoot area 138 via a suitable adhesive or other mechanical structures. Still further, permanent affixation may not be necessary if a coefficient of friction between forefoot area 136 of sock liner 118 and the forefoot area 138 of insole 112 is of a very high value and possibly approaching an infinite coefficient of friction, i.e., the sock liner forefoot area 136 being frictionally affixed to the insole forefoot area 138. As described above, low friction area 124 of sock liner 118 (and especially low friction layer 126) engages directly with insole low friction area 128 of insole 112 and particularly with the low friction layer 134. As shown in FIGS. 7 and 8, when a wearer's foot is positioned in footwear 100 and on sole structure 104, and the wearer undertakes an athletic pivoting action, the wearer's foot is relatively fixed in the forefoot area 106 because sock liner 118 and insole 112 are constructed such that there is little or no relative movement therebetween in this area. This restriction of medial and lateral movement within the shoe is enhanced by having a very high coefficient of friction between the wearer's foot and/or sock and the top layer 120 of sock liner 118. However, in contrast to forefoot area 106, the provision of sock liner low friction area 124 and insole low friction area 128 allows the heel area 110 of sock liner 118 to move slightly in both the medial (see FIG. 7) and lateral (see FIG. 8) directions with respect to insole 112 (and thus sole structure 104). There may be performance benefits to be gained by allowing the foot to naturally pivot about the midfoot region during cutting and turning motions. Aspects hereof provide for a pivoting action to allow the forefoot of a wearer to remain fixed while the heel of a wearer moves slightly in the medial or lateral directions relative to the outsole depending upon the cutting motions. The extent of the medial and lateral pivoting of the wearer's heel is limited by the engagement of the medial (see FIG. 7) and lateral (see FIG. 8) heel portions of the wearer with the medial side wall structure 140 and the lateral side wall structure 142 of upper 102, respectively. As depicted in FIGS. 7 and 8, because of the desire to allow some heel movement while setting a limit thereto, it may be preferable to add a reinforcing heel cup or similar reinforcing structure 144 in the heel area 110 of upper 102.

As described, it is desirable to have the forefoot area 136 of sock liner 118 relatively fixed with respect to insole forefoot area 138. Still further, it is desirable to have a relatively low friction engagement between the heel area of sock liner 118 and the heel area of insole 112. A potential coefficient of friction between sock liner low friction area 124 and insole low friction area 128 can be on the order of 0.15 to 0.2. However, other levels or ranges of coefficient of friction in the heel portion between the sock liner and the insole may be appropriate, insomuch as they provide a lower friction coefficient in the heel portion than is present in the forefoot portion.

Figure 9:
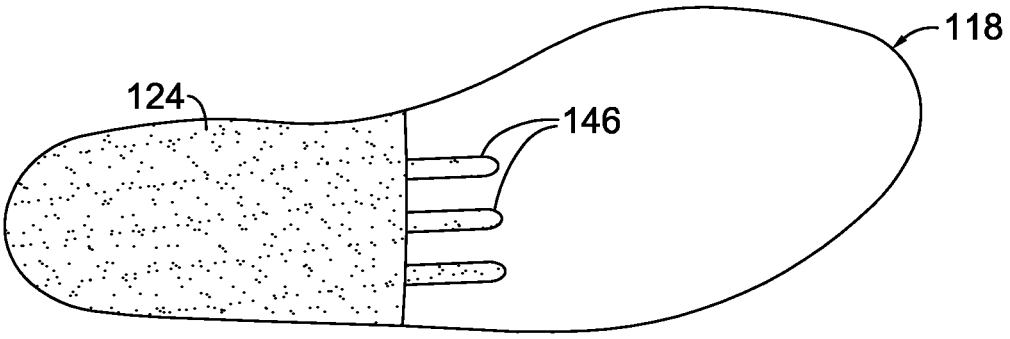
FIG. 9 depicts a bottom plan view of a sock liner including a frictional transition region, in accordance with an aspect hereof.

With reference to FIG. 9, other aspects herein are shown. More specifically, there may be a desire to have a friction transition between the forefoot area 106 of sock liner 118 and the heel area 110 of sock liner 118. This can be provided by positioning low fiction fingers 146 in the midfoot area 108 of sock liner 118. Low friction fingers 146 can be made of the same low friction material as is found in sock liner low friction area 124 described above. Further, low friction fingers 146 can be of any form or orientation within the midfoot area 108 of sock liner 118.

Figure 10:
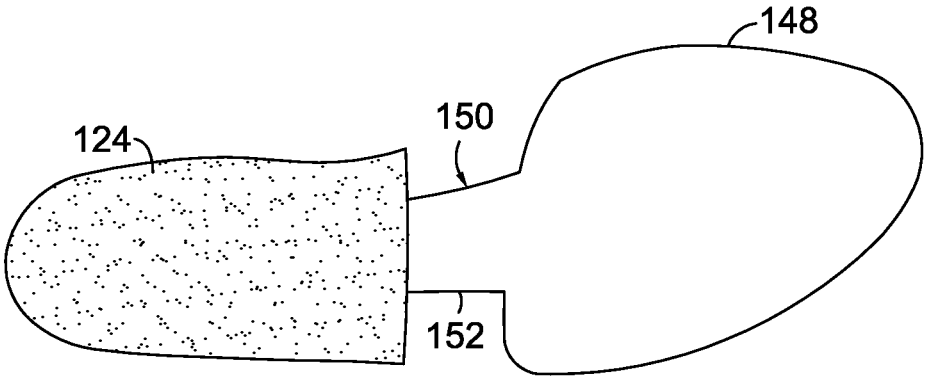
FIG. 10 depicts a bottom plan view of a sock liner including a reduced material transition section to allow easier articulation of the heel area, in accordance with an aspect hereof.
Figure 12:
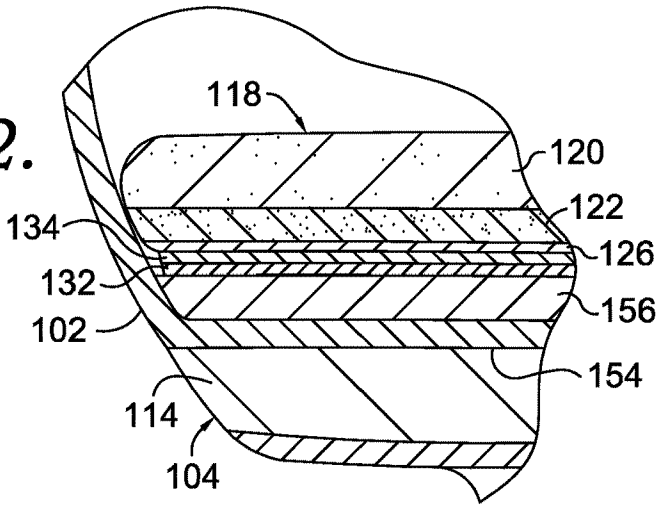
FIG. 12 depicts an enlargement of region 12 in FIG. 11, in accordance with an aspect hereof.

With reference to FIG. 10, another aspect is described. In FIG. 10, another sock liner 148 is described. Sock liner 148 is similar to sock liner 118 and has the provision of a low friction area 124 in the heel region. Sock liner 148 includes cutouts 150 and 152 which reduce the amount of material in sock liner 148 in the midfoot area 108. Reducing the material in midfoot area 108 of sock liner 148 allows for the heel area 110 of sock liner 148 to more easily pivot laterally side to side during functioning of the sock liner 148 with respect to insole 112.

Figure 11:
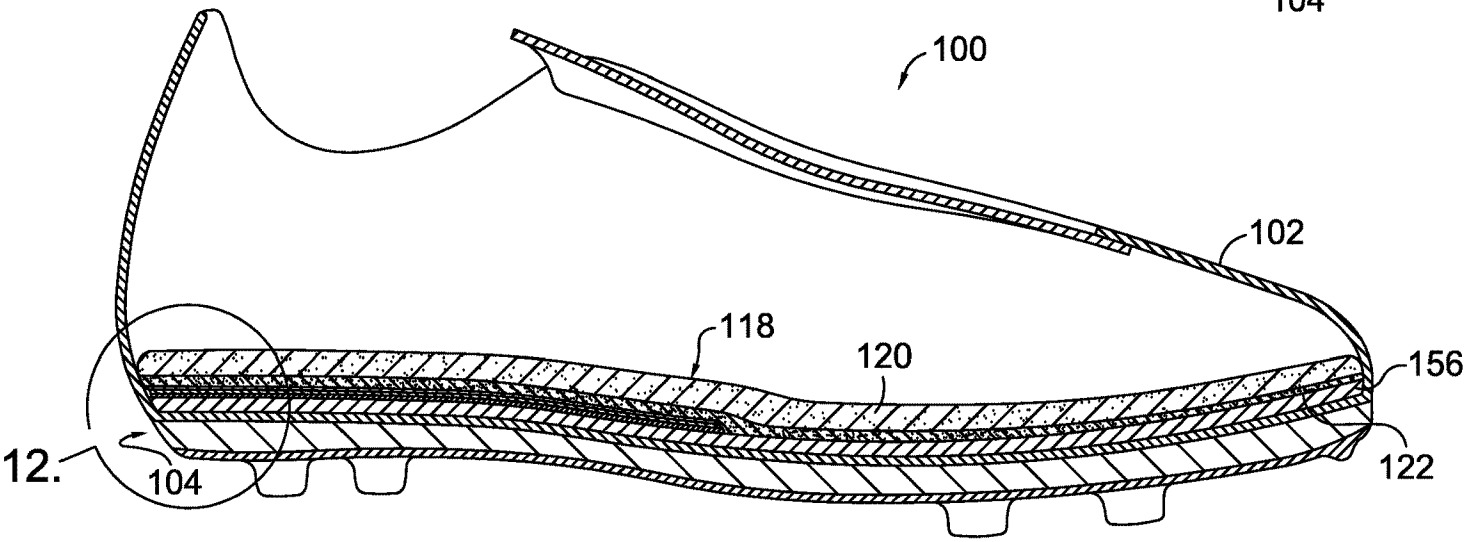
FIG. 11 depicts a sectional view similar to FIG. 3, in accordance with an additional aspect hereof.

As shown in FIG. 11, a further aspect is described wherein a footwear construction 100 has an insole 112 that is not stitched as part of upper 102. More specifically, upper 102 completely encompasses a wearer's foot and has a stitch line extending along the bottom of the wearer's foot. Upper 102 is secured to midsole 114 along this bottom portion 154. Secured to an interior surface of upper 102 opposite bottom portion 154 is an insole 156. Insole 156 is similar to insole 112, except for the fact that it is secured to the interior surface of the upper as opposed to being part of and stitched to upper 102 as shown in FIG. 3. Insole 156 covers up the seam used in the lasting of upper 102. As described, insole 156 is secured to upper 102. Sock liner 118 is identical to the sock liner of FIG. 1 and is positioned on top of insole 156. Again sock liner 118 has the same low friction area 124. Still further insole 156 has a similar corresponding low friction area 128 to insole 112. Thus the functionality described above with respect to the footwear 100 of FIG. 1 is virtually identical to the footwear 100 of FIG. 11. That is, the forefoot area of sock liner 118 is fixed relative to insole 156 and the rear foot area of sock liner 118 is allowed to pivot medially and laterally during use of the shoe in relation to insole 156.

While aspects hereof focus on a two-layer construction, it is contemplated that that three or more layers may interact with varied degrees of relative frictional engagement. For example, it is contemplated that a sock surface, a top and bottom surface of a sock liner, and a top surface of a strobel or midsole engage to provide and support a limited differential friction pivot motion in a particular region, such as the heel region. Further, it is contemplated that other layers in different combination interact to provide the differential friction pivot action in one or more regions. Additionally, it is contemplated that other differential friction interaction may be implemented, such as an interaction between the foot of a wearer and a sock, the foot of a wearer and a sock liner, the foot of the wearer and one or more portions of a foot bed, for example.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

The invention claimed is:

1. A footbed of an article of footwear, the footbed comprising:

a sole structure including a lower ground engaging surface and an upper foot facing surface, wherein the upper foot facing surface has a first forefoot surface and a first rear foot surface;

a sock liner including a lower surface facing the sole structure foot facing surface, an upper surface adapted to face and engage the foot of the wearer, and a perimeter edge connecting the lower surface to the upper surface and forming a profile shape of the foot engaging member generally corresponding with a shape of the footbed, a full extent of the sock liner terminating at the perimeter edge and in the footbed, the lower surface comprising a second forefoot surface that contacts the first forefoot surface and a second rear foot surface that contacts the first rear foot surface; and wherein the first and second rear foot surfaces comprise a low friction area having a lower coefficient of friction than a higher friction area included in the first and second forefoot surfaces.

2. The footbed of claim 1, wherein the upper surface of the sock liner comprises a first material layer having the perimeter edge, wherein the lower surface of the sock liner is comprised of an additional layer that includes only a portion of the perimeter edge and that forms the second rear foot surface, and wherein the second forefoot surface does not include the additional layer.

3. The footbed of claim 2, wherein the second forefoot surface is comprised of the first material layer.

4. The footbed of claim 2, wherein a bottom insole-engaging layer having the perimeter edge is affixed to the first material layer; wherein the additional layer is coupled to the bottom insole-engaging layer; and wherein the bottom insole-engaging layer comprises the second forefoot surface.

5. The footbed of claim 2, wherein the second forefoot surface of the sock liner is secured to the first forefoot surface of the sole structure by an adhesive.

6. The footbed of claim 2, wherein relative movement of the forefoot region of the sock liner is prevented with respect to the forefoot region of the sole structure by providing a high coefficient of friction between the respective forefoot regions.

7. The footbed of claim 1, wherein the first rear foot surface and the second rear foot surface is made of a lubricious fluoropolymer material.

8. The footbed of claim 1, wherein the sock liner upper surface is made of a highly compressible foam.

9. A shoe comprising:

a sole structure including a forefoot region, a midfoot region and a rear foot region;

an upper secured to the sole structure and enclosing a foot-receiving cavity, the upper including a forefoot region, a midfoot region, and a rear foot region having a medial side wall and a lateral side wall;

an insole including a forefoot region, a midfoot region, and a rear foot region, the insole including a bottom surface facing towards the sole structure, a top surface facing away from the bottom surface, and a thickness between the bottom surface and the top surface, wherein the insole includes a perimeter edge connecting the bottom surface to the top surface and forming a profile shape of the insole generally corresponding with a shape of a footbed of the shoe;

a sock liner positioned within the foot-receiving cavity, the sock liner including a forefoot region, a midfoot region, and a rear foot region, wherein the sock liner includes a lower surface facing the top surface of the insole, an upper surface adapted to face the foot-receiving cavity, and a perimeter edge connecting the lower surface to the upper surface and forming a profile shape of the sock liner generally corresponding with the shape of the footbed; and wherein the profile shape of the sock liner is larger than the profile shape of the insole;

the sock liner including a first area in the sock liner rear foot region and a second area in the forefoot region of the sock liner, the first area associated with a lower coefficient of friction relative to the second area; wherein the sock liner is relatively fixed to the forefoot region of the insole and the first area of the sock liner engages the rear foot region of the insole so as to allow movement of the rear foot region of the sock liner in the lateral and medial directions, such that the sock liner rear foot region moves closer to the lateral side wall when moving in the lateral direction and closer to the medial side wall when moving in the medial direction, the insole rear foot region being associated with a lower coefficient of friction relative to the forefoot region of the insole.

10. The shoe construction of claim 9, wherein the forefoot area of the insole is relatively fixed to the forefoot region of the sock liner through the provision of a high coefficient of friction.

11. The shoe of claim 9, wherein the rear foot region of the sock liner extends further rearward than the rear foot region of the insole.

12. The shoe of claim 9, wherein a full extent of a width of the sock liner terminates between the medial side wall and the lateral side wall.

13. The shoe of claim 9, wherein the insole is a strobel affixed to a bottom edge of the upper.

14. The shoe of claim 13, wherein a first layer of material is affixed to the top surface of the strobel in the rear foot region and between the strobel and the sock liner, and wherein the first layer of material comprises a low friction area.

15. The shoe of claim 14, wherein a second layer of material is affixed between the first layer of material and the sock liner, and wherein the second layer of material is a very low friction material layer.

16. The shoe of claim 14, wherein the sock liner includes a top foot-engaging layer and a bottom insole-engaging layer.

17. The shoe of claim 16, wherein the top foot-engaging layer comprises a thicker and softer material than the bottom insole-engaging layer.

18. The shoe of claim 13, wherein the strobel is affixed to the bottom edge along a stitch line covered by the sock liner.

19. A sock liner for an article of footwear comprising:

a first longitudinal layer including a toe region, a midfoot region, and a heel region, the first longitudinal layer having a first upper surface, a first lower surface, and a first perimeter edge connecting the first upper surface to the first lower surface and forming a first terminal boundary around the first longitudinal layer, the first longitudinal layer being made of a highly compressible first material, the full extent of the first longitudinal layer terminating at the first perimeter edge;

a second longitudinal layer including a toe region, a midfoot region, and a heel region, the second longitudinal layer having a second upper surface flush against the first lower surface and having a second lower surface, the second longitudinal layer being made of a material that is less compressible than the first material, wherein the second longitudinal layer includes a second perimeter edge connecting the second upper surface to the second lower surface and forming a second terminal boundary around the second longitudinal layer, the full extent of the second longitudinal layer terminating at the second perimeter edge;

a low friction area positioned on the lower surface of the second longitudinal layer in the heel region of the second longitudinal layer and allowing side-to-side movement; and a high friction area positioned on the lower surface of the second longitudinal layer in the mid foot region.

20. The sock liner of claim 19, wherein the low friction area comprises an additional layer of material affixed to, and exposed on, the lower surface of the second longitudinal layer, and wherein the high friction area includes an exposed portion of the second longitudinal layer.

* * * * *